US008836631B2

(12) United States Patent
Shin

(10) Patent No.: US 8,836,631 B2
(45) Date of Patent: Sep. 16, 2014

(54) SCAN DRIVING CIRCUIT WITH A SHIFT REGISTER AND ELECTROLUMINESCENT DISPLAY USING THE SAME

(75) Inventor: Dong Yong Shin, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1279 days.

(21) Appl. No.: 11/655,221

(22) Filed: Jan. 19, 2007

(65) Prior Publication Data

US 2007/0229409 A1 Oct. 4, 2007

(30) Foreign Application Priority Data

Mar. 29, 2006 (KR) ..... 10-2006-0028611

(51) Int. Cl.

| | |
|---|---|
| ***G09G 3/36*** | (2006.01) |
| ***G09G 3/32*** | (2006.01) |
| *G09G 3/30* | (2006.01) |

(52) U.S. Cl.

CPC ..... *G09G 3/3266* (2013.01); *G09G 2310/08* (2013.01); *G09G 3/30* (2013.01); *G09G 2310/0267* (2013.01); *G09G 2330/021* (2013.01)

USPC ..... 345/100

(58) Field of Classification Search

CPC G09G 3/3266; G09G 3/30; G09G 2310/0267

USPC ..... 345/76–82; 377/64–81

See application file for complete search history.

(56) References Cited

U.S. PATENT DOCUMENTS

| | | | | |
|---|---|---|---|---|
| 5,701,136 | A | 12/1997 | Huq et al. | |
| 6,426,743 | B1 * | 7/2002 | Yeo et al. | 345/213 |
| 6,621,886 | B2 * | 9/2003 | Kawahata | 377/1 |
| 2004/0104882 | A1 | 6/2004 | Kitani et al. | |
| 2005/0008114 | A1 | 1/2005 | Moon | |
| 2005/0156856 | A1 * | 7/2005 | Jang et al. | 345/100 |
| 2006/0044247 | A1 | 3/2006 | Jang et al. | |

FOREIGN PATENT DOCUMENTS

| | | |
|---|---|---|
| JP | 08-263028 | 10/1996 |
| JP | 2004-185684 | 7/2004 |
| JP | 2004-334926 | 11/2004 |
| KR | 10-2005-0037657 A | 4/2005 |
| KR | 10-2005-0055913 A | 6/2005 |
| KR | 10-2005-0068284 A | 7/2005 |
| KR | 10-2006-0020325 A | 3/2006 |

* cited by examiner

*Primary Examiner* — Dennis Joseph

(74) *Attorney, Agent, or Firm* — Lee & Morse, P.C.

(57) ABSTRACT

A scan driving circuit having a shift register unit with a plurality of stages, each stage includes an input terminal; an output terminal; first, second, and third clock terminals; a first transistor in communication with the input terminal and the second clock terminal, the first transistor configured to transfer the input signal according to a signal from the second clock terminal; a switch section in communication with the input terminal, the output terminal, and the first clock terminal, the switch section configured to receive the input signal from the first transistor and transfer a first exterior voltage signal to the output terminal according to the input signal and a signal from the first clock terminal; and a storage section configured to receive and store the input signal from the first transistor, and to transfer a signal from the third clock terminal to the output terminal according to the input signal.

16 Claims, 5 Drawing Sheets

SCAN DRIVING CIRCUIT WITH A SHIFT REGISTER AND ELECTROLUMINESCENT DISPLAY USING THE SAME

BACKGROUND OF THE INVENTION

1. Field of the Invention

The present invention relates to a scan driving circuit. In particular, the present invention relates to a scan driving circuit capable of reducing power consumption and an electroluminescent display using the same.

2. Description of the Related Art

In general, an electroluminescent (EL) display is a flat display device, where voltage may be applied via drive and scan lines to light emitting layers to form images.

A conventional EL display may be an active matrix type display having a plurality of scan lines, e.g., horizontally arranged rows, a plurality of data lines arranged perpendicularly to the scan lines, and a plurality of pixels arranged at intersection points between data lines and scan lines to form a matrix pattern. The scan and data lines may provide scan and data signals, respectively, to the plurality of pixels via at least one driving circuit.

The conventional driving circuit of an EL display may include a shift register unit having a plurality of stages connected in cascade. The plurality of stages may be supplied with an input signal along with high-level and low-level driving voltages and clock signals to sequentially shift an output signal from one stage to another, i.e., an output signal of each stage may become an input signal of the following stage. Accordingly, the input signal may be shifted and provided through an output of each stage to a respective line, such that a plurality of output signals may be transmitted through a plurality of lines, e.g., scan lines or data lines, to the pixel matrix of the EL display.

Each stage of the conventional driving circuit may include a master-slave flip-flop with an inverter. In other words, when a clock signal is at a low level ('0'), the flip-flop may receive an input signal but maintain a previous output signal. On the other hand, when the clock changes to a high level ('1'), the flip-flop may maintain its previous input, i.e., an input received when the clock signal was at the low level ('0'), while outputting a new output signal with respect to the input signal. Further, the flip-flop operation may include electric current flow in the inverter either through an input transistor or through a load transistor to charge or discharge, respectively, an output terminal of the flip-flop.

However, when the clock signal of the flip-flop of the conventional scan driving circuit is at a low level, the inverter incorporated therein may produce a static current flow and, thereby, increase the overall power consumption of the flip-flop. Such power consumption may be increased even further as the number of the inverters receiving low-level clock signals increases. Further, upon charging of the output terminal, i.e., electric current flow through the input transistor of the inverter, a source-gate voltage of the load transistor may be gradually reduced, thereby decreasing the discharge current therethrough. Such decrease in the discharge current may deteriorate the overall discharge efficiency of the driving circuit.

Additionally, an output voltage of each stage of the conventional driving circuit may be determined by a transistor connected between a power supply VDD and a ground, such that a high output voltage level may be set by a voltage value of the transistor and a low voltage level may be set to be greater than that of the ground by a threshold voltage of an input transistor. However, since levels of an input voltage may be different at every stage of the shift register unit, voltage deviations due to the transistor may affect the output voltage at a low level, thereby triggering incorrect operation of the driving circuit. Moreover, low level voltage deviations due to the transistor may cause deviations in the resistance of the input transistor and inverter, thereby triggering voltage deviation of the high level output voltage as well. Such voltage deviations may increase even further in an organic EL display due to the characteristic high voltage deviations associated with the transistors employed therein.

Accordingly, there exists a need for a driving circuit of an EL display having an improved structure capable of providing reduced power consumption and improved circuit operation and discharge efficiency.

SUMMARY OF THE INVENTION

The present invention is therefore directed to a scan driving circuit and an EL display using the same that substantially overcome one or more of the problems due to the limitations and disadvantages of the related art.

It is therefore a feature of an exemplary embodiment of the present invention to provide a scan driving circuit having a structure capable of reducing power consumption, increasing circuit discharge efficiency, and improving overall circuit operation.

It is yet another feature of an exemplary embodiment of the present invention to provide an EL display employing a scan driving circuit capable of reducing power consumption, increasing circuit discharge efficiency, and improving overall circuit operation.

At least one of the above and other features and advantages of the present invention may be realized by providing a scan driving circuit having a shift register unit with a plurality of stages, each stage including an input terminal configured to provide an input signal; an output terminal; first, second, and third clock terminals; a first transistor in communication with the input terminal and the second clock terminal, the first transistor configured to transfer the input signal according to a signal from the second clock terminal; a switch section in communication with the input terminal, the output terminal, and the first clock terminal, the switch section configured to receive the input signal from the first transistor and transfer a first exterior voltage signal to the output terminal according to the input signal and a signal from the first clock terminal; and a storage section configured to receive and store the input signal from the first transistor, and to transfer a signal from the third clock terminal to the output terminal according to the input signal.

The storage section may include a second transistor in communication with the first transistor and a capacitor, wherein the second transistor may be configured to transfer the signal from the third clock terminal to the output terminal. The switch section may include a third transistor, a fourth transistor, and a fifth transistor, wherein the fifth transistor may be configured to transfer the first exterior voltage signal to the output terminal according to signals transferred through the third and fourth transistors.

The third transistor may be coupled between a second exterior voltage source and a third node and having a gate connected to the first clock terminal, and the fifth transistor may be coupled between the first exterior voltage source and the output terminal and having a gate connected to the third node. The fourth transistor may be coupled between the first clock terminal and the third node. The fourth transistor may have a gate connected to the first external voltage source or a first node.

The scan driving circuit may further include a sixth transistor coupled between the first exterior supply line and the fourth transistor. The sixth transistor may have a gate connected to a first node or the third clock terminal. If a sixth transistor is included, the fourth transistor may be coupled between the sixth transistor and the third node. Additionally, the fourth transistor may have a gate connected to the first node or the third clock terminal.

The signals from the first and second clock terminals may be at a high level, the signal from the third clock terminal may be at a low level, and the output terminal may provide a low level output voltage. The low level output voltage may be the input signal of a following stage.

The first, second and third clock terminals may transmit signals having horizontal periods with identical lengths and shifted phases. Each horizontal period may include a precharge period, an input period, and an evaluation period. The first exterior voltage source may be a power supply source. The second exterior voltage source may be a ground or a low voltage source.

In another aspect of the present invention, there is provided an electroluminescent display, including a pixel portion; a data driving circuit connected to a plurality of data lines; and a scan driving circuit connected to a plurality of scan lines, wherein the scan driving circuit may have a shift register unit with a plurality of stages, each stage including an input terminal, an output terminal, three clock terminals, a first transistor, a switch section, and a storage section, such that the switch section may be configured to receive an input signal from the first transistor and transfer a first exterior voltage signal to the output terminal according to the input signal and a signal from the first clock terminal, and wherein the storage section may be configured to receive and store the input signal from the first transistor, and to transfer a signal from the third clock terminal to the output terminal according to the input signal.

The output terminal of each stage may transfer an output signal to a respective scan line and a following stage. Additionally, the electroluminescent display may be an organic light emitting display.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
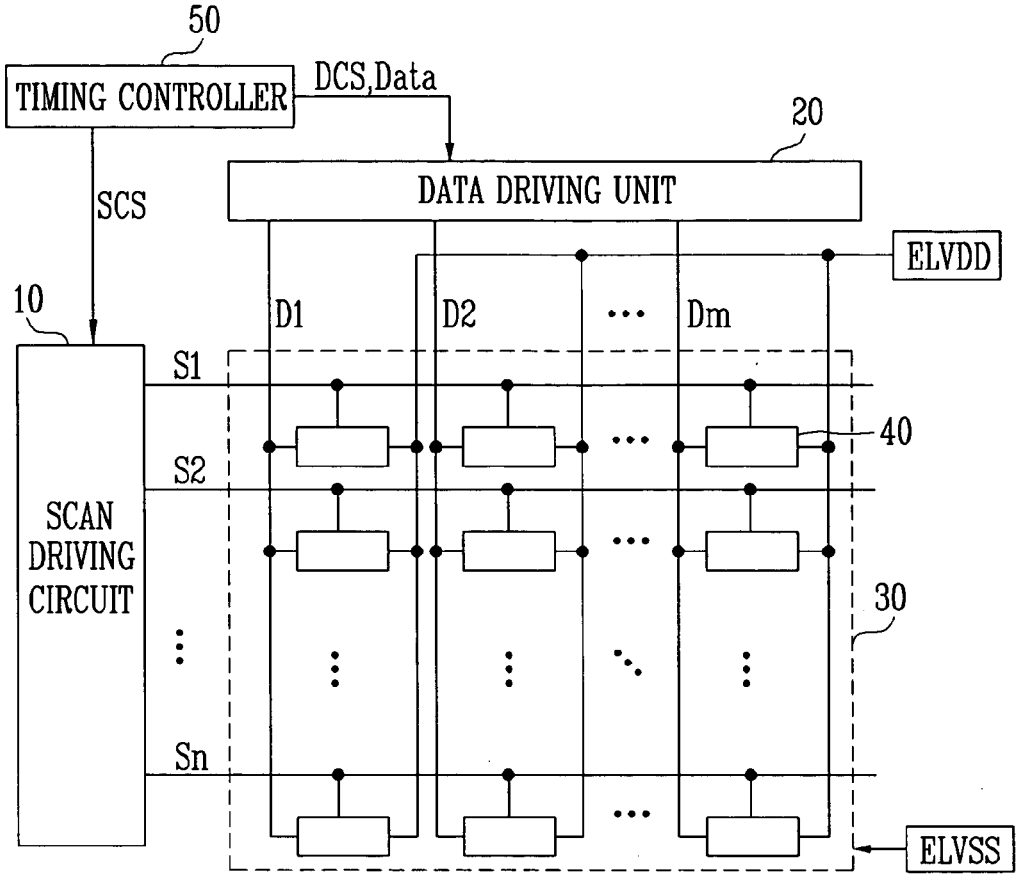
FIG. 1 illustrates a block diagram of an EL display according to an exemplary embodiment of the present invention.

Korean Patent Application No. 10-2006-0028611, filed on Mar. 29, 2006, in the Korean Intellectual Property Office, and entitled: "Scan Driving Circuit and Organic Light Emitting Display Using the Same," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

It will further be understood that when an element is referred to as being "on" another element or substrate, it can be directly on the other element or substrate, or intervening elements may also be present. Further, it will be understood that when an element is referred to as being "under" another element, it can be directly under, or one or more intervening elements may also be present. In addition, it will also be understood that when an element is referred to as being "between" two elements, it can be the only element between respective two elements, or one or more intervening elements may also be present. Like reference numerals refer to like elements or layers throughout.

FIG. 1 illustrates a block diagram of an electroluminescent (EL) display according to an exemplary embodiment of the present invention. Referring to FIG. 1, the EL display, e.g., an organic light emitting display, may include a pixel portion 30 having a plurality of pixels 40 connected to scan lines (S1 . . . Sn) and data lines (D1 . . . Dm), a scan driving circuit 10 configured to drive the scan lines (S1 . . . Sn), a data driving circuit 20 configured to drive the data lines (D1 . . . Dm), and a timing controller 50 configured to control the scan driving circuit 10 and the data driving circuit 20.

The timing controller 50 may generate a data driver control signal (DCS) and a scan driver control signal (SCS) in correspondence to synchronization signals supplied from an external source. The data driver control signal (DCS) and the scan driver control signal (SCS) generated by the timing controller 50 may be supplied to the data driving circuit 20 and the scan driving circuit 10, respectively. The timing controller 50 may receive data from an external source and supply the (DATA) to the data driving circuit 20.

The data driving circuit 20 may receive the data driver control signal (DCS) from the timing controller 50. The data driving circuit 20 may generate data signals and supply the generated data signals to the data lines (D1 to Dm), so as to synchronize with a scan signal.

The pixel portion 30 may receive a first power supply (ELVDD) and a second power supply (ELVSS) from an external source, and supply them to each of the pixels 40. Each of the pixels 40 receiving the first power supply (ELVDD) and the second power supply (ELVSS) may generate light corresponding to the data signal by controlling a current flowing from the first power supply (ELVDD) to the second power supply (ELVSS) via an electroluminescent element.

The scan driving circuit 10 may receive the scan driver control signal (SCS) from the timing controller 50. The scan driving circuit 10 may generate a scan signal and sequentially supply the generated scan signal to the scan lines (S1 to Sn) to drive the plurality of pixels 40 of the pixel portion 30. The scan driving circuit 10 may further generate an emission control signal in response to the scan drive control signal (SCS) and sequentially supply the generated emission control signal to the emission control lines (not shown).

A detailed description of an exemplary embodiment of a scan driving circuit 10 of an EL display according to the present invention will be explained with respect to FIGS. 2-4.

Figure 2:
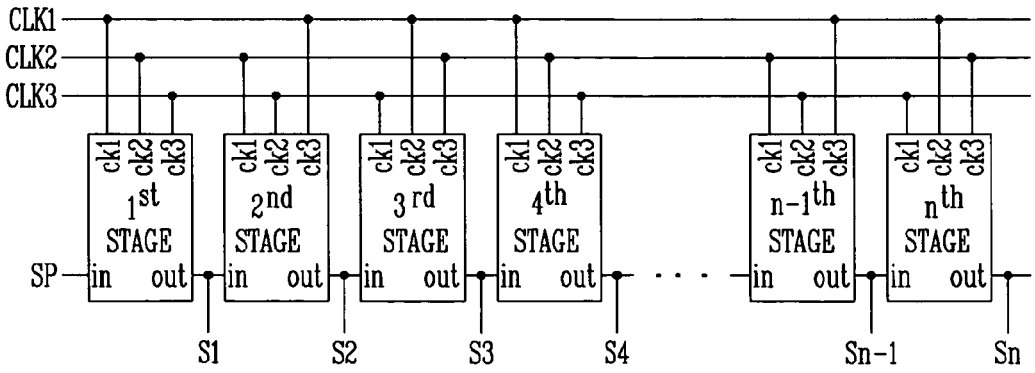
FIG. 2 illustrates a block diagram of a scan driving circuit illustrated in FIG. 1.

As illustrated in FIG. 2, the scan driving circuit 10 of the EL display described previously with respect to FIG. 1 may include a shift register unit having n stages, an input signal line, first through third clock signal CLK1-CLK3, and n output signals coupled with respective scan lines (S1 . . . Sn) of the EL display.

Each stage of the shift register unit may include an input terminal, an output terminal and first, second and third clock terminals Ck1, Ck2 and Ck3. The input terminal of the first stage may be connected to the input signal line of the scan driving circuit 10, such that an input signal of the first stage of the shift register unit may be a start pulse SP. The input signal of each sequential stage, i.e., input signals of second to n-th stages, may be an output signal of a preceding stage, as illustrated in FIG. 2. Accordingly, each output signal of first to (n−1) th stages may be transmitted to a respective scan line (S1 . . . Sn−1) and shifted to the following stage as an input signal. The last stage, i.e., the n-th stage of the shift register unit, may be transferred to the S, scan line. A transfer of an input signal through one stage of the shift register unit may occur for a duration of one horizontal period, wherein each horizontal period may be divided into a pre-charge period, an input period, and an evaluation period with respect to signal phases of the first, second and third clocks CLK1, CLK2 and CLK3. In this respect, it should be noted that a horizontal period of each clock signal may be identical in length to one another. However, each clock signal may have a shifted phase, e.g., one third of a horizontal period, with respect to one another. For example, the first clock signal CLK1 may be at a low level during the first third of the horizontal period, the second clock signal CLK2 may be at a low level during the second third of the horizontal period, and the third clock signal CKL3 may be at a low level during the last third of the horizontal period, as illustrated in FIG. 4.

The first, second and third clock signals CLK1, CLK2 and CLK3 may be supplied to each of the stages, i.e., first through n-th stages, via the first, second and third clock terminals Ck1, Ck2 and Ck3. In particular, as illustrated in FIG. 2, the first, second and third clock signals CLK1, CLK2 and CLK3 may be supplied to the first, second and third clock terminals Ck1, Ck2 and Ck3, respectively, of a (3k−2)-th stage, i.e., first stage, fourth stage, and so forth. Similarly, the first, second and third clock signals CLK1, CLK2 and CLK3 may be supplied to the third, first and second clock terminals Ck3, Ck1 and Ck2, respectively, of a (3k−1)-th stage, i.e., second stage, fifth stage, and so forth. Similarly, the first, second and third clock signal CLK1, CLK2 and CLK3 may be supplied to the second, third and first clock terminals Ck2, Ck3 and Ck1, respectively, of a (3k−2)-th stage, i.e., third stage, sixth stage, and so forth. In this respect, it should be noted that k is a natural number.

For example, in response to the first, second and third clock signals CLK1, CLK2 and CLK3 transmitted to the first, second and third clock terminals Ck1, Ck2 and Ck3 of the first stage, respectively, the first stage may transmit an output signal to an input terminal of the second stage. In response to the output signal received from the first stage, the second stage may output a second signal to an input terminal of the third stage and so forth. Each signal may be transmitted through the n stages of the shift register unit to sequentially drive the pixel portion 30 of the EL display via the scan lines (S1 . . . Sn).

An external control circuit may provide the input signals of the scan driving circuit 10, i.e., the start pulse SP, the first to third clock signals CLK1-CLK3, and exterior voltage sources, such as power supply line VDD, ground, low voltage supply, and so forth.

A detailed description of an exemplary embodiment of a stage in a shift register unit of the driving circuit 10 of the EL display according to the present invention will be explained with respect to FIGS. 3-4.

Figure 3:
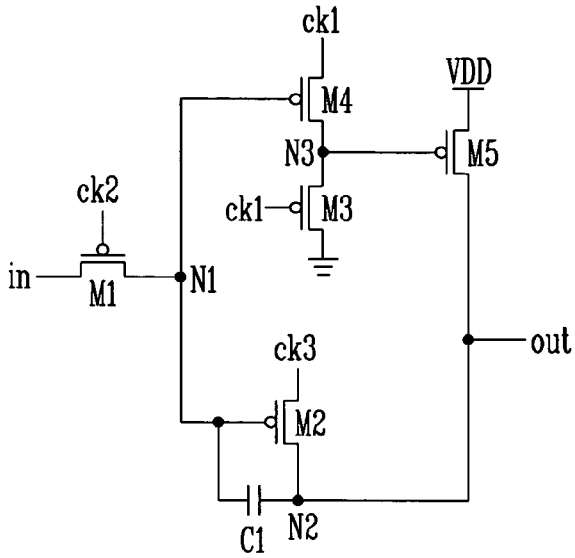
FIG. 3 illustrates a circuit diagram of an exemplary embodiment of a stage of the scan driving circuit illustrated in FIG. 2.
Figure 4:
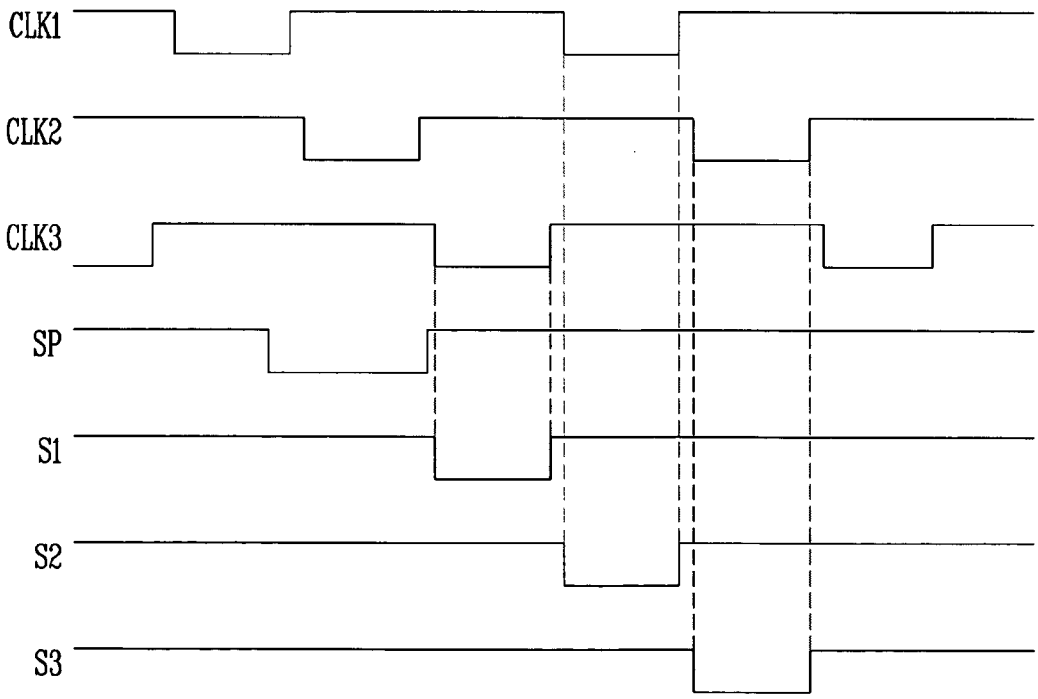
FIG. 4 illustrates a timing chart of the stage illustrated in FIG. 3.

As illustrated in FIG. 3, each stage of the scan driving circuit 10 described previously with respect to FIG. 2 may include a first PMOS transistor M1, a second PMOS transistor M2, a third PMOS transistor M3, a fourth PMOS transistor M4, a fifth PMOS transistor M5, and a capacitor C. The first through fifth PMOS transistors M1-M5 may be configured to sequentially transmit a low level output through each stage of the shift register in order to shift signals through the scan driving circuit 10. In other words, the scan driving circuit 10 of the present invention may output a high level signal to the pixel portion 30, unless a specific driving signal is transmitted through its plurality of stages n by transmitting a low level signal in order to drive the scan lines (S1 . . . Sn).

The first PMOS transistor M1 may include a gate coupled with a second clock terminal Ck2 to control receipt of an input signal, i.e., an output voltage signal from a previous stage or a start pulse SP, such that the input signal may be selectively transferred, i.e., with respect to a clock signal at the second clock terminal Ck2, to a first node N1. The second PMOS transistor M2 may include a gate connected to the first node N1, and may be coupled between the third clock terminal CK3 and a second node N2. The third PMOS transistor M3 may include a gate connected to the first clock terminal CK1, and may be coupled between a ground voltage source and a third node N3. The fourth PMOS transistor M4 may include a gate connected to the first node N1, and may be coupled between the first clock terminal CK1 and the third node N3. The fifth PMOS transistor M5 may include a gate connected to the third node N3, and may be coupled between a power supply line VDD and the second node N2. The capacitor C may be connected between the first node N1 and the second node N2, and may maintain a predetermined voltage.

It should be noted that the ground voltage source may be either ground or a negative power supply. Additionally, the second PMOS transistor M2 and the capacitor C may be collectively referred to as a "storage section". Similarly, the configuration of the third, fourth and fifth PMOS transistors M3, M4 and M5 may be collectively referred to as a "switch section."

Operation of each stage with respect to transistor and clock signal configuration is as follows. For example, operation of the (3k−2)-th stage, as illustrated in FIG. 4, may include input of a low level signal to the first clock terminal Ck1 during the pre-charge period, while a high level signal may be inputted to the second and third clock terminals Ck2 and Ck3 to pre-charge the capacitor C. In this respect, it should be noted that low and high level signals refer to inputs of '0' and '1', respectively. Next, during the input period, a low level signal may be inputted to the second clock Ck2, while a high level signal may be inputted to the first and third clock terminals Ck1 and Ck3 to input the start pulse SP or the output signal of a previous stage into an input terminal of the (3k−2)-th stage. Finally, during the evaluation period, a low level signal may be inputted to the third clock terminal Ck3, while a high level signal may be inputted to the first and second clock terminals Ck1 and Ck2 to output a low level signal.

In more detail, during the pre-charge period, i.e., when the first clock CLK1 is at a low level, the third PMOS transistor M3 may be activated to make the third node N3 a ground voltage. Accordingly, the fifth PMOS transistor M5 may be activated to transmit an output signal, i.e., a high level signal corresponding to the power supply line VDD, through the output terminal.

During the input period, i.e., when the second clock CLK2 is at a low level, the input signal, i.e., the start pulse SP or a signal of a previous stage, may be transferred through the first PMOS transistor M1 into the first node N1, such that the input signal may be stored in the capacitor C. Because the input signal is at a low level, the second PMOS transistor M2 and the fourth transistor M4 may be activated. Simultaneously, since the first clock CLK1 is at a high level, the third PMOS transistor M3 may be turned-off. When the third PMOS transistor M3 is turned-off and the fourth PMOS transistor M4 is turned-on, the first clock signal CLK1 may transfer a high level signal to the fifth PMOS transistor M5 and turn it off. Accordingly, the activated second PMOS transistor M2 may transmit an output signal, i.e., a high level signal corresponding to the third clock signal CLK3, through the output terminal.

During the evaluation period, i.e., when the third clock CLK3 is at a low level, the first PMOS transistor M1 may be at a floating-state, thereby triggering a low voltage state for the capacitor C and activating the second and fourth PMOS transistors M2 and M4. Further, the third and fifth PMOS transistors M3 and M5 may be turned-off. Accordingly, the activated second PMOS transistor M2 may transmit an output signal, i.e., a low level signal corresponding to the third clock signal CLK3, through the output terminal.

In other words, a high voltage signal corresponding to the power supply line VDD may be transmitted through the output terminal of each stage during the pre-charge period, a high voltage signal corresponding to the third clock signal CLK3 may be transmitted through the output terminal of each stage during the input period, and a low voltage signal corresponding to the third clock signal CLK3 may be transmitted through the output terminal of each stage during the evaluation period. In this respect, it should be noted that the high and low levels of output signals transmitted through the output terminal of each stage during the input and evaluation periods may correspond to the high and low voltage states of the capacitor C, respectively. Accordingly, the output terminal of each stage may transmit a signal having a low or a high voltage.

If the input signal has a high level voltage, the output terminal may maintain a low level signal. Accordingly, each sequential stage may receive a low level signal outputted from the previous stage and, thereby, output a low level signal as well, such that each scan signal may be shifted sequentially through the n stages of the scan driving circuit 10.

Figure 5:
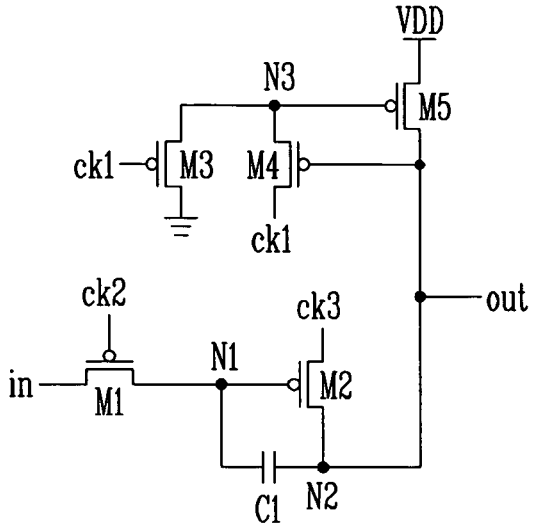
FIG. 5 illustrates a circuit diagram of another exemplary embodiment of a stage of the scan driving circuit illustrated in FIG. 2.

In another exemplary embodiment of a stage of the driving circuit 10 of the EL display according to the present invention illustrated in FIG. 5, each stage of the scan driving circuit 10 may include the same components previously described with respect to FIG. 3, i.e., five PMOS transistors M1 through M5, respectively, and a capacitor C. However, the component configuration may be different. In particular, the first PMOS transistor M1 may transfer an input signal to the first node N1 in response to the second clock signal CLK2, and the second PMOS transistor M2 may transfer the third clock signal CLK3 to the second node N2 with respect to a voltage level of the first node N1. The third PMOS transistor M3 may transfer a ground voltage to a gate of the fifth transistor PMOS M5 in response to the first clock signal CLK1. The fourth PMOS transistor M4 may transfer the first clock signal CLK1 to a gate of the fifth PMOS transistor M5 with respect to a voltage level outputted through the output terminal. Finally, the fifth PMOS transistor M5 may transfer a voltage of the power supply line VDD to the output terminal with respect to a voltage level of a gate thereof, i.e., voltage signal received from the fourth PMOS transistor M4. The capacitor C may be connected between the first node N1 and the second node N2 and may maintain a predetermined voltage.

A stage having the configuration described in FIG. 5 may operate with respect to horizontal periods determined by the first, second and third clock signals CLK1, CLK2 and CLK3 described previously with respect to FIG. 4. In particular, during the pre-charge period, i.e., when the first clock CLK1 is at a low level, the third PMOS transistor M3 may be activated to make the third node N3 a ground voltage. Accordingly, the fifth PMOS transistor M5 may be activated to transmit an output signal, i.e., a high level signal corresponding to the power supply line VDD, through the output terminal.

During the input period, i.e., when the second clock CLK2 is at a low level, the input signal, i.e., the start pulse SP or the output signal of a previous stage, may be transferred through the first PMOS transistor M1 into the first node N1, such that the input signal may be stored in the capacitor C. Because the input signal is at a low level, the second PMOS transistor M2 may be activated to transmit an output signal, i.e., a high level signal corresponding to the third clock signal CLK3, through the output terminal.

During the evaluation period, i.e., when the third clock CLK3 is at a low level, the first PMOS transistor M1 may be at a floating-state, thereby triggering a low voltage state for the capacitor C and activating the second PMOS transistors M2 to transmit an output signal, i.e., a low level signal corresponding to the third clock signal CLK3, through the output terminal. In this respect, it should be noted that during the evaluation period, i.e., when the first clock CLK1 is at a low level and the second PMOS transistor M2 transmits a low level output signal, the fourth PMOS transistor M4 may be activated to transfer a high level signal with respect to the first clock signal CLK1 to the gate of the fifth PMOS transistor M5, thereby preventing signal transfer from the power supply line VDD to the output terminal.

Figure 6:
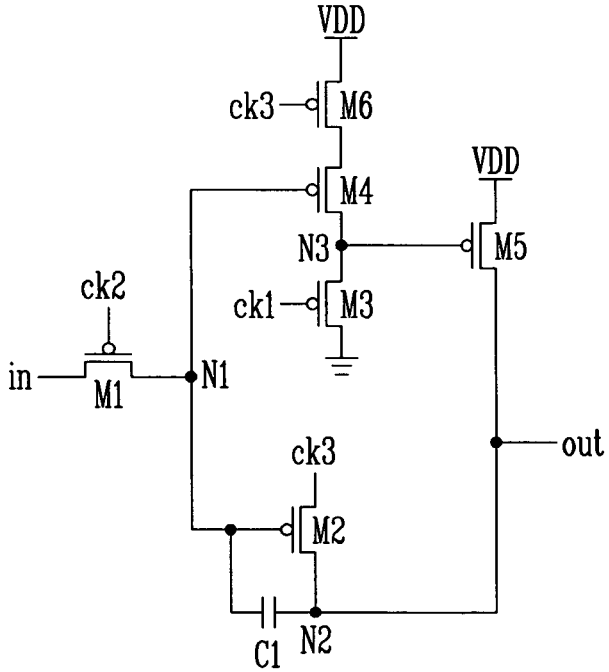
FIG. 6 illustrates a circuit diagram of another exemplary embodiment of a stage of the scan driving circuit illustrated in FIG. 2.

In another exemplary embodiment of a stage of the driving circuit 10 of the EL display according to the present invention illustrated in FIG. 6, each stage of the scan driving circuit 10 may include the same components previously described with respect to FIG. 3 with the exception of a sixth PMOS transistor M6. The sixth PMOS transistor M6 may include a gate connected to the third clock terminal Ck3, and may be coupled between the fourth PMOS transistor M4 and the power supply line VDD.

Accordingly, during the evaluation period, i.e., when the third clock CLK3 is at a low level, the sixth PMOS transistor M6 may be activated to transfer a signal from the power supply line VDD to the fourth PMOS transistor M4. The fourth PMOS transistor M4 may be activated with respect to the voltage stored in the capacitor C to transfer the voltage of the power supply line VDD to the third node N3, thereby turning off the fifth PMOS transistor M5. In other words, the voltage of the power supply line VDD, as opposed to a clock signal, may be used to turn the fifth PMOS transistor M5 on or off. Accordingly, when the third clock CLK3 is at a low level, the fifth PMOS transistor M5 may be turned on or off, thereby preventing signal transfer from the power supply line VDD to the output terminal and securing a low level output through the output terminal.

Figure 7:
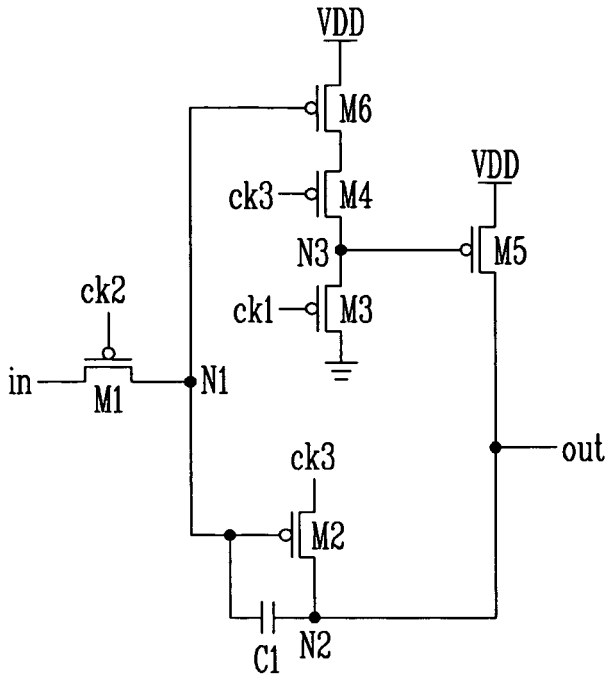
FIG. 7 illustrates a circuit diagram of another exemplary embodiment of a stage of the scan driving circuit illustrated in FIG. 2.

In another exemplary embodiment of a stage of the driving circuit 10 of the EL display according to the present invention illustrated in FIG. 7, each stage of the scan driving circuit 10 may include the same components previously described with respect to FIG. 6 with the exception that the sixth PMOS transistor M6 may include a gate connected to the first node N1, while the fourth PMOS transistor M4 may include a gate connected to the third clock terminal Ck3. Accordingly, during the evaluation period, i.e., when the third clock CLK3 is at a low level, the voltage of the power supply line may be transferred to the third node N3 in the same manner as that of FIG. 6, i.e., activation of the fourth and sixth PMOS transistors M4 and M6.

Figure 8:
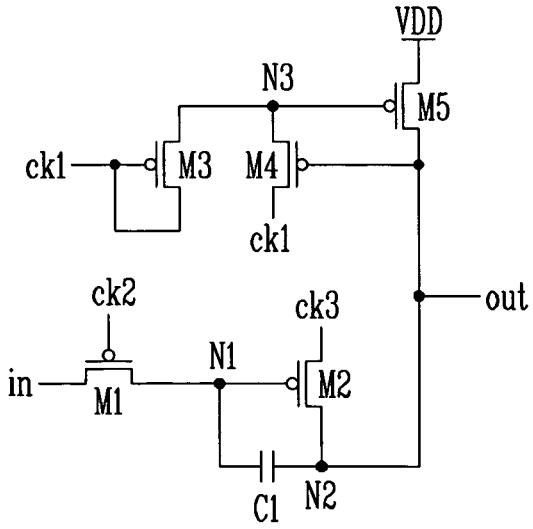
FIG. 8 illustrates a circuit diagram of another exemplary embodiment of a stage of the scan driving circuit illustrated in FIG. 2.

In another exemplary embodiment of a stage of the driving circuit 10 of the EL display according to the present invention illustrated in FIG. 8, each stage of the scan driving circuit 10 may include the same components previously described with respect to FIG. 5 with the exception that the first clock signal may function both as a source and a gate signal of the third PMOS transistor M3. Accordingly, during the pre-charge period, i.e., when the first clock CLK1 is at a low level, the fifth PMOS transistor M5 may be activated to transmit a high level signal from the power supply line VDD. The input and evaluation periods of the embodiment illustrated in FIG. 8 are similar to the description provided with respect to FIG. 5 and, therefore, will not be repeated herein.

Figure 9:
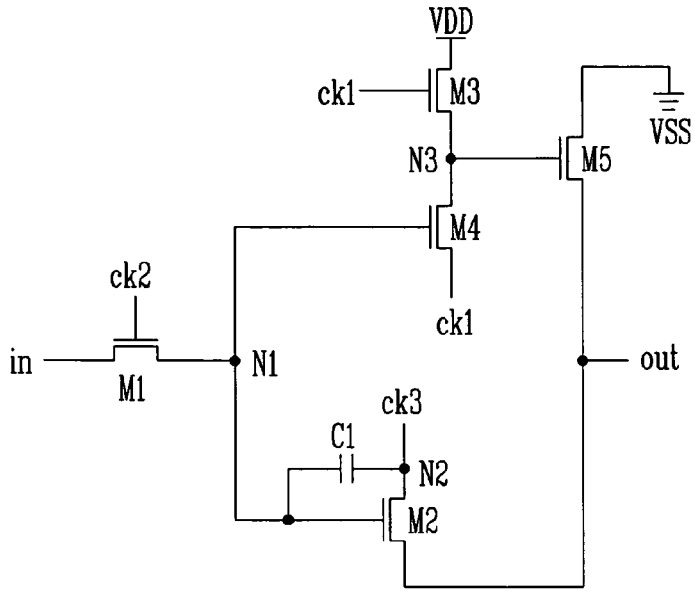
FIG. 9 illustrates a circuit diagram of another exemplary embodiment of a stage of the scan driving circuit illustrated in FIG. 2.
Figure 10:
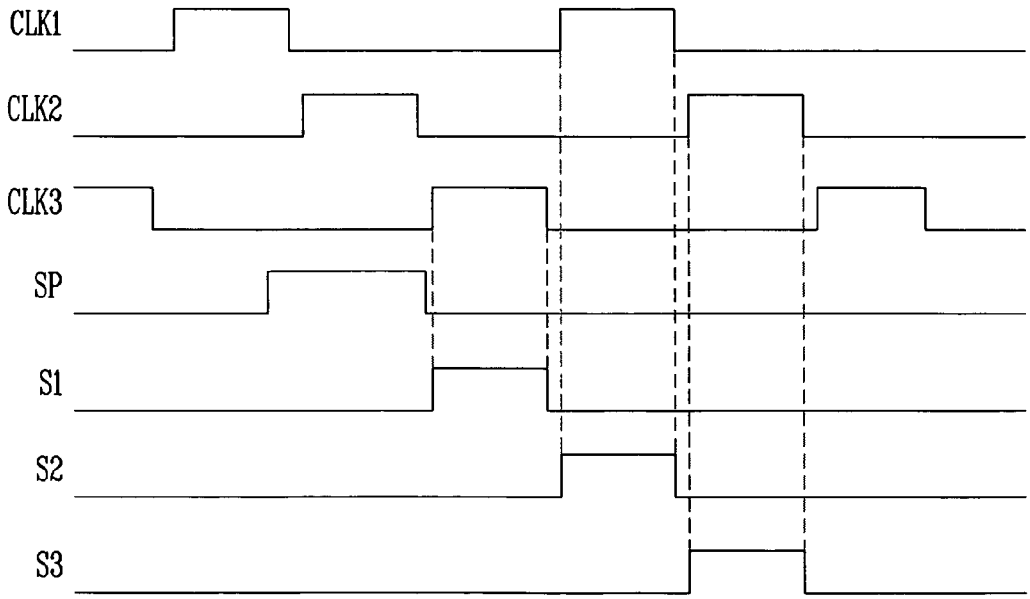
FIG. 10 illustrates a timing chart of the stage illustrated in FIG. 9.

In another exemplary embodiment of a stage of the driving circuit 10 of the EL display according to the present invention illustrated in FIGS. 9-10, each stage of the scan driving circuit 10 may include a similar configuration and components previously described with respect to FIG. 3 with the exception that transistors are NMOS type transistors.

The present invention may be advantageous because a switching effect may be enhanced with respect a low voltage or a high voltage supplied by respective clock signals in order to reduce a static current flow, thereby reducing power consumption and improving overall circuit operation. Furthermore, use of a plurality of clock signals may increase a discharge efficiency of the scan driving circuit.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A scan driving circuit having a shift register unit with a plurality of stages, each stage comprising:

an input terminal configured to provide an input signal;

an output terminal;

first, second, and third clock terminals configured to transmit respective first, second, and third clock signals;

a first transistor configured to transfer the input signal from the input terminal according to the second clock signal from the second clock terminal, the second clock terminal being directly connected to a gate of the first transistor;

a switch section configured to transfer a first supply voltage signal from a first voltage source to the output terminal according to the first clock signal from the first clock terminal when the input signal is transmitted through the first transistor, wherein the switch section includes a third transistor, a fourth transistor, and a fifth transistor, the fifth transistor being configured to transfer the first supply voltage signal from the first voltage source to the output terminal according to signals transferred through the third and fourth transistors, the third transistor is directly connected between a second voltage source and having a gate directly connected to the first clock terminal, and the fifth transistor is connected between the first voltage source and the output terminal; and a storage section including a second transistor and a capacitor, the capacitor maintaining a predetermined voltage configured to receive and store the input signal from the first transistor and to activate the second transistor by controlling on/off the third clock signal from the third clock terminal to the output terminal according to the input signal.

2. The scan driving circuit as claimed in claim 1, wherein the fourth transistor is connected between the first clock terminal and the third transistor.

3. The scan driving circuit as claimed in claim 2, wherein the third transistor has a gate connected to a third node.

4. The scan driving circuit as claimed in claim 2, wherein the third transistor has a gate connected to the second node or the third clock terminal.

5. The scan driving circuit as claimed in claim 1, further comprising a sixth transistor coupled between the first voltage source and the third transistor.

6. The scan driving circuit as claimed in claim 5, wherein the sixth transistor has a gate connected to a second node or the third clock terminal.

7. The scan driving circuit as claimed in claim 6, wherein the third transistor is coupled between the sixth transistor and the first node.

8. The scan driving circuit as claimed in claim 1, wherein the first and second clock signals from the first and second clock terminals, respectively, are high level, the third clock signal from the third clock terminal is low level, and the output terminal provides a low level output voltage.

9. The scan driving circuit as claimed in claim 8, wherein the low level output voltage is the input signal of a following stage.

10. The scan driving circuit as claimed in claim 1, wherein the first, second and third clock terminals transmit signals having horizontal periods with identical lengths and shifted phases.

11. The scan driving circuit as claimed in claim 10, wherein each horizontal period includes a pre-charge period, an input period, and an evaluation period.

12. The scan driving circuit as claimed in claim 1, wherein the first voltage source is a drive power source.

13. The scan driving circuit as claimed in claim 1, wherein the second voltage source is a ground source or a low voltage source.

14. An electroluminescent display, comprising:

a pixel portion;

a data driving circuit connected to a plurality of data lines; and a scan driving circuit connected to a plurality of scan lines, the scan driving circuit having a shift register unit with a plurality of stages, each stage including:

an input terminal;

an output terminal;

first, second, and third clock terminals configured to transmit respective first, second, and third clock signals;

a first transistor configured to transfer the input signal from the input terminal according to the second clock signal from the second clock terminal, the second clock terminal being directly connected to a gate of the first transistor;

a switch section configured to receive an input signal from the first transistor and transfer a first voltage signal from a first voltage source to the output terminal according to the input signal and a first clock signal from the first clock terminal, wherein the switch section includes a third transistor, a fourth transistor, and a fifth transistor, the fifth transistor being configured to transfer the first supply voltage signal from the first voltage source to the output terminal according to signals transferred through the third and fourth transistors, the third transistor is directly connected between a second voltage source and having a gate directly connected to the first clock terminal, and the fifth transistor is connected between the first voltage source and the output terminal; and a storage section including a second transistor and a capacitor, the capacitor maintaining a predetermined voltage configured to receive and store the input signal from the first transistor and to activate the second transistor by controlling on/off the third clock signal from the third clock terminal to the output terminal according to the input signal.

15. The electroluminescent display as claimed in claim 14, wherein the output terminal of each stage transfers an output signal to a respective scan line and a following stage.

16. The electroluminescent display as claimed in claim 14, wherein the electroluminescent display is an organic light emitting display.

* * * * *